US010197366B2

(12) United States Patent
Padgett et al.

(10) Patent No.: US 10,197,366 B2
(45) Date of Patent: Feb. 5, 2019

(54) POLYMER-BASED CARTRIDGE CASING FOR BLANK AND SUBSONIC AMMUNITION

(71) Applicant: PCP Tactical LLC, Vero Beach, FL (US)

(72) Inventors: Charles Padgett, Vero Beach, FL (US); Robert Lanse Padgett, Vero Beach, FL (US)

(73) Assignee: PCP Tactical, LLC, Vero Beach, FL (US)

( * ) Notice: Subject to any disclaimer, the term of this patent is extended or adjusted under 35 U.S.C. 154(b) by 0 days.

(21) Appl. No.: 15/964,911

(22) Filed: Apr. 27, 2018

(65) Prior Publication Data

US 2018/0245891 A1 Aug. 30, 2018

Related U.S. Application Data

(60) Continuation-in-part of application No. 15/187,421, filed on Jun. 20, 2016, now Pat. No. 9,995,561, which is a continuation of application No. 14/642,922, filed on Mar. 10, 2015, now Pat. No. 9,372,054, which is a continuation of application No. 14/315,564, filed on Jun. 26, 2014, now Pat. No. 9,003,973, application (Continued)

(51) Int. Cl.

| | |
|---|---|
| ***F42B 5/30*** | (2006.01) |
| ***F42B 5/307*** | (2006.01) |
| ***F42B 8/04*** | (2006.01) |
| ***F42B 33/02*** | (2006.01) |
| ***F42B 12/76*** | (2006.01) |
| ***F42B 5/313*** | (2006.01) |

(52) U.S. Cl.

CPC ..... *F42B 5/307* (2013.01); *F42B 5/313* (2013.01); *F42B 8/04* (2013.01); *F42B 12/76* (2013.01); *F42B 33/02* (2013.01)

(58) Field of Classification Search

CPC .... F42B 5/30; F42B 5/307; F42B 5/32; F42B 5/34; F42B 5/28; F42B 5/313; F42B 8/02; F42B 8/04; F42B 8/10

USPC ..... 102/439

See application file for complete search history.

(56) References Cited

U.S. PATENT DOCUMENTS 3,034,433 A * 5/1962 Gronn ..... F42B 5/295 102/464

3,099,958 A * 8/1963 Daubenspeck ..... F42B 5/307 102/449

(Continued)

*Primary Examiner* — Joshua E Freeman

(74) *Attorney, Agent, or Firm* — Troutman Sanders LLP

(57) ABSTRACT

A polymer-based cartridge for subsonic ammunition with a first end having a projectile disposed in a mouth, a shoulder forming a bottleneck cartridge; and at least a polymer wall between the first end and a second end opposite the first. An insert is joined to the second end, having an extraction rim and groove, a primer pocket communicating with a flash hole, and the flash hole communicating with a propellant chamber. A sleeve section has a metal or a metal alloy, extending from the insert toward the first end, and at least partially covered by the wall. The sleeve section and the wall form the propellant chamber having a thickness at least 1.25 times greater than a standard thickness of a wall of a standard cartridge. The propellant chamber between the mouth and the insert is unobstructed, and comprises a powder load having a load density greater than 40%.

8 Claims, 19 Drawing Sheets

Related U.S. Application Data

No. 15/964,911, which is a continuation-in-part of application No. 13/828,311, filed on Mar. 14, 2013, now abandoned, said application No. 14/315,564 is a division of application No. 13/549,351, filed on Jul. 13, 2012, now Pat. No. 8,763,535, which is a continuation-in-part of application No. 13/350,585, filed on Jan. 13, 2012, said application No. 13/828,311 is a continuation-in-part of application No. 13/350,585.

(60) Provisional application No. 61/433,170, filed on Jan. 14, 2011.

(56) References Cited

U.S. PATENT DOCUMENTS 4,157,684 A * 6/1979 Clausser ..... F42B 5/02 102/430
4,867,065 A * 9/1989 Kaltmann ..... F42B 8/04 102/444
5,063,853 A * 11/1991 Bilgeri ..... B82Y 15/00 102/444
5,770,815 A * 6/1998 Watson, Jr. ..... F42B 5/16 102/439
6,283,035 B1 * 9/2001 Olson ..... F42B 5/02 102/439
8,763,535 B2 * 7/2014 Padgett ..... F42B 5/313 102/467
9,395,165 B2 * 7/2016 Maljkovic ..... F42B 33/10
2003/0019385 A1 * 1/2003 LeaSure ..... F42B 5/025 102/444
2007/0261587 A1 * 11/2007 Chung ..... F42B 5/313 102/469
2012/0180687 A1 * 7/2012 Padgett ..... F42B 5/313 102/466
2013/0014664 A1 * 1/2013 Padgett ..... F42B 5/313 102/439
2014/0060373 A1 * 3/2014 Maljkovic ..... F42B 33/10 102/467
2015/0122142 A1 * 5/2015 Padgett ..... F42B 5/313 102/439
2016/0349022 A1 * 12/2016 Burrow ..... F42B 5/307
2016/0349023 A1 * 12/2016 Burrow ..... F42B 5/307

* cited by examiner

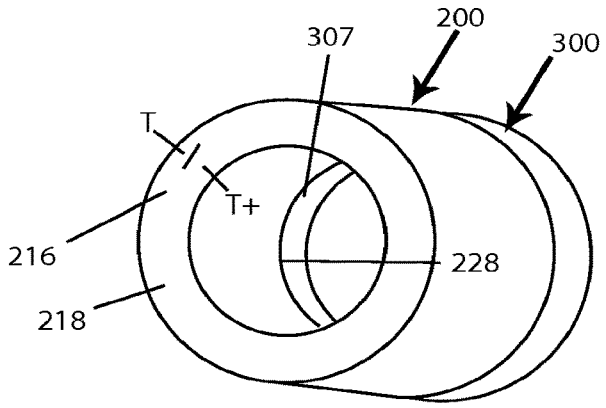
Fig. 4
Fig. 5
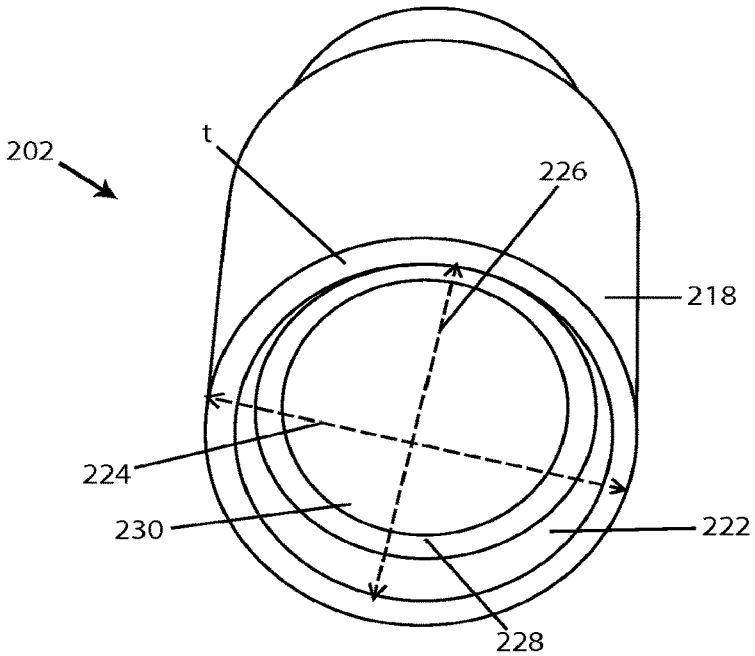

POLYMER-BASED CARTRIDGE CASING FOR BLANK AND SUBSONIC AMMUNITION

CROSS-REFERENCE TO RELATED APPLICATIONS

This application is a Continuation-In Part of U.S. application Ser. No. 15/187,421 filed Jun. 20, 2016, which is a Continuation of U.S. application Ser. No. 14/642,922, filed Mar. 10, 2015, now U.S. Pat. No. 9,372,054, which is a Continuation of U.S. application Ser. No. 14/315,564 filed Jun. 26, 2014, now U.S. Pat. No. 9,003,973, which is a Divisional of U.S. application Ser. No. 13/549,351 filed Jul. 13, 2012, now U.S. Pat. No. 8,763,535, which is Continuation-In-Part of abandoned U.S. application Ser. No. 13/350,585, filed Jan. 13, 2012, which claims priority to U.S. Provisional Application Ser. No. 61/433,170 filed Jan. 14, 2011.

This application is also a Continuation-In-Part of U.S. application Ser. No. 13/828,311, filed Mar. 14, 2013, which is a Continuation-In-Part of U.S. application Ser. No. 13/350,585, filed Jan. 13, 2012 which claims priority to U.S. Provisional Application Ser. No. 61/433,170 filed Jan. 14, 2011.

All applications above are incorporated herein by reference.

TECHNICAL FIELD

The present subject matter relates to techniques and equipment to make ammunition articles and, more particularly, to ammunition articles with plastic components such as cartridge casing bodies and bases for at least blank and subsonic ammunition.

BACKGROUND

It is well known in the industry to manufacture bullets and corresponding cartridge cases from either brass or steel. Typically, industry design calls for materials that are strong enough to withstand extreme operating pressures and which can be formed into a cartridge case to hold the bullet, while simultaneously resist rupturing during the firing process.

Conventional ammunition typically includes four basic components, that is, the bullet, the cartridge case holding the bullet therein, a propellant used to push the bullet down the barrel at predetermined velocities, and a primer, which provides the spark needed to ignite the powder which sets the bullet in motion down the barrel.

The cartridge case is typically formed from brass and is configured to hold the bullet therein to create a predetermined resistance, which is known in the industry as bullet pull. The cartridge case is also designed to contain the propellant media as well as the primer.

However, brass is heavy, expensive, and potentially hazardous. For example, the weight of 0.50 caliber ammunition is about 60 pounds per box (200 cartridges plus links).

The bullet is configured to fit within an open end or mouth of the cartridge case and conventionally includes a groove (hereinafter referred to as a cannelure) formed in the mid-section of the bullet to accept a crimping action imparted to the metallic cartridge case therein. When the crimped portion of the cartridge case holds the bullet by locking into the cannelure, a bullet pull value is provided representing a predetermined tension at which the cartridge case holds the bullet. The bullet pull value, in effect, assists imparting a regulated pressure and velocity to the bullet when the bullet leaves the cartridge case and travels down the barrel of a gun.

Furthermore, the bullet is typically manufactured from a soft material, such as, for example only, lead, wherein the bullet accepts the mouth of the cartridge being crimped to any portion of the bullet to hold the bullet in place in the cartridge case, even though the cartridge case is crimped to the cannelure of the bullet.

However, one drawback of this design is that the crimped neck does not release from around the bullet evenly when fired. This leads to uncertain performance from round to round. Pressures can build up unevenly and alter the accuracy of the bullet.

The propellant is typically a solid chemical compound in powder form commonly referred to as smokeless powder. Propellants are selected such that when confined within the cartridge case, the propellant burns at a known and predictably rapid rate to produce the desired expanding gases. As discussed above, the expanding gases of the propellant provide the energy force that launches the bullet from the grasp of the cartridge case and propels the bullet down the barrel of the gun at a known and relatively high velocity.

The primer is the smallest of the four basic components used to form conventional ammunition. As discussed above, primers provide the spark needed to ignite the powder that sets the bullet in motion down the barrel. The primer includes a relatively small metal cup containing a priming mixture, foil paper, and relatively small metal post, commonly referred to as an anvil.

When a firing pin of a gun or firearm strikes a casing of the primer, the anvil is crushed to ignite the priming mixture contained in the metal cup of the primer. Typically, the primer mixture is an explosive lead styphnate blended with non-corrosive fuels and oxidizers which burns through a flash hole formed in the rear area of the cartridge case and ignites the propellant stored in the cartridge case. In addition to igniting the propellant, the primer produces an initial pressure to support the burning propellant and seals the rear of the cartridge case to prevent high-pressure gases from escaping rearward. It should be noted that it is well known in the industry to manufacture primers in several different sizes and from different mixtures, each of which affects ignition differently.

The cartridge case, which is typically metallic, acts as a payload delivery vessel and can have several body shapes and head configurations, depending on the caliber of the ammunition. Despite the different body shapes and head configurations, all cartridge cases have a feature used to guide the cartridge case, with a bullet held therein, into the chamber of the gun or firearm.

The primary objective of the cartridge case is to hold the bullet, primer, and propellant therein until the gun is fired. Upon firing of the gun, the cartridge case seals the chamber to prevent the hot gases from escaping the chamber in a rearward direction and harming the shooter. The empty cartridge case is extracted manually or with the assistance of gas or recoil from the chamber once the gun is fired.

As shown in FIG. 1A, a bottleneck cartridge case 10 has a body 11 formed with a shoulder 12 that tapers into a neck 13 having a mouth at a first end. A primer holding chamber 15 is formed at a second end of the body opposite the first end. A divider 16 separates a main cartridge case holding chamber 17, which contains a propellant, from the primer holding chamber 15, which communicate with each other via a flash hole channel 18 formed in the web area 16. An exterior circumferential region of the rear end of the cartridge case includes an extraction groove 19*a* and a rim 19*b*.

Prior art patents in this area include U.S. Pat. No. 4,147,107 to Ringdal, U.S. Pat. No. 6,845,716 to Husseini et al., U.S. Pat. No. 7,213,519 to Wiley et al., and U.S. Pat. No. 7,610,858 to Chung. The four patents are directed to an ammunition cartridge suitable for rifles or guns and including a cartridge case made of at least a plastics material. However, each have their own drawbacks.

Further, the use of brass cartridges for blank or subsonic ammunition can be problematic. To reduce the velocity of the bullet exiting the cartridge, typically less propellant is used is comparison to when the bullet is traveling at its top velocity. However, the same size cartridge needs to be used so the bullet can be fired from a standard firearm. An empty space is left inside a blank or subsonic cartridge where the propellant would normally reside. To compensate, wadding (typically cotton) can be packed into the space normally filled by the propellant. This wadding can cause problems with the use of the round, including jamming the firearm and fouling silencers and/or suppressors attached to the firearm.

Other inventions attempting to address some of the above issues include U.S. Pat. No. 6,283,035 to Olsen, which places an expanding insert into a brass cartridge, and U.S. Patent Application Publication No. 2003/0019385 to Lea-Sure which uses a heavier than standard bullet with a reduced capacity cartridge.

Hence, a need exists for a polymer casing that can perform as well as or better than the brass alternative. A further improvement is polymer casings that are capable of production in a more conventional and cost-effective manner, i.e. by using standard loading presses. Additionally, the cartridge can provide increased performance for blank and subsonic rounds.

SUMMARY

The invention includes examples of a high strength polymer-based cartridge for subsonic ammunition with a first end having a mouth, a projectile disposed in the mouth, a shoulder disposed below the mouth forming a bottleneck cartridge; and at least a wall, molded from a polymer, between the first end and a second end opposite the first end. Further, included is an insert joined to the second end, having an extraction rim and a groove both disposed at one end of the insert; and a primer pocket in fluid communication with a flash hole, the flash hole in fluid communication with a propellant chamber. A sleeve section is also included having a metal or a metal alloy, extending from the insert toward the first end, and at least partially covered by the wall. The sleeve section and the wall form the propellant chamber and have a thickness at least 1.25 times greater than a standard thickness of a wall of a standard cartridge. The propellant chamber between the mouth and the insert is unobstructed, and comprises a powder load having a load density greater than 40%.

Examples of the high strength polymer-based cartridge have the insert made from a metal, an alloy of metals, or an alloy of a metal and a non-metal. Other examples allow the sleeve section to end below the shoulder. Further, the insert and the sleeve section can be integral and the insert consists of a metal or a metal alloy.

Examples of the sleeve section can have a ridge formed on the sleeve section; and a key formed on the ridge. Both the ridge and the key engage the wall, and the key has at least one of a flat portion, a raised portion, or dimples. The sleeve section can further comprise knurling. Also, the sleeve section can further include the neck and the mouth. In examples, the propellant chamber permits only enough propellant to propel the projectile engaged in the cartridge casing at subsonic speeds.

As a result, a light weight, high strength cartridge case can be formed using standard brass cartridge loading equipment. As noted below, the present invention can be adapted to any type of cartridge, caliber, powder load, or primer. Calibers can range at least between .22 and 30 mm and accept any type of bullet that can be loaded in a typical brass cartridge.

Further advantages can be gained in both blank and subsonic ammunition due to the removal of wadding and the shrinking of the volume of powder based on a reduced volume in the cartridge.

The polymer used can be of any known polymer and additives, but the present invention uses a nylon polymer with glass fibers. Further, the portion of the cartridge that engages the extractor of the firearm can be made from heat strengthened steel for normal loads and can be a continuous molded polymer piece of the lower component for either subsonic or blank ammunition.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 4 is a bottom, side, perspective, radial cross-section of the upper and lower components of the cartridge;

FIG. 5 is an end view of the upper component without the lower component and insert;

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The present invention provides a cartridge case body strong enough to withstand gas pressures that equal or surpass the strength of brass cartridge cases under certain conditions, e.g. for both storage and handling.

Figure 2:
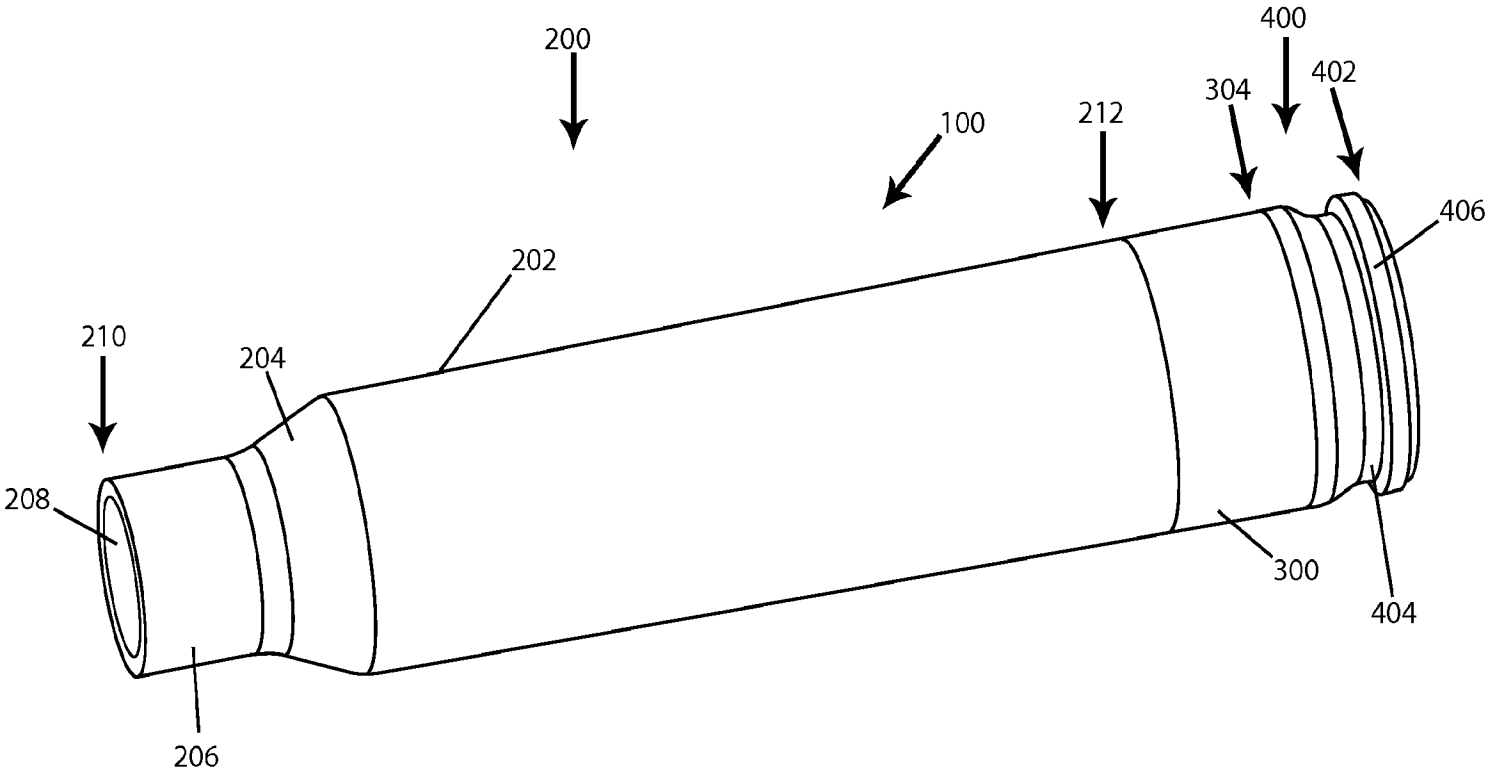
FIG. 2 is a side perspective view of the outside of cartridge case of the present invention.

Reference now is made in detail to the examples illustrated in the accompanying drawings and discussed below. FIG. 2 illustrates an example of a cartridge case 100. The cartridge case 100 includes an upper component 200, a lower component 300, and an insert 400. In this example, the upper component 200 and the lower component 300 are made of a polymer, while insert 400 is made from a metal, an alloy of metals, or an alloy of a metal and a non-metal. Regardless of materials, the outer dimensions of the cartridge case 100 are within the acceptable tolerances for whatever caliber firearm it will be loaded into.

The polymer used is lighter than brass. A glass-filled high impact polymer can be used where the glass content is between 0%-50%, preferably between 5% and 50%. In another example the glass content can be 10%. An example of a high impact polymer without the glass content is BASF's Capron® BU50I. The insert 400 can be made of steel, and, in an example, heat treated carbon steel, 4140. The 4140 steel is further heat treated to a Rockwell "C" scale ("RC") hardness of about 20 to about 50. However, any carbon steel with similar properties, other metals, metal alloys or metal/non-metal alloys can be used to form the insert. Heat treating a lower cost steel alloy to improve its strength is a point of distinction from the prior art, which have typically opted for more expensive alloys to deal with the strength and ductility needed for a cartridge casing application.

Further to the above, as noted for the insert, any metal, metal alloy, or non-metal alloys, ranging from the common place (e.g. brass) to the exotic (e.g. ceramics), can be used to form the insert. The main requirement is to withstand both the explosive and subsequent extractive forces subjected to the insert. The ability to form the insert easily and inexpensively are of a separate consideration. The same holds true for the polymer, it can be of any type or quality as long as it meets the requirements of the specific example noted below.

In an example, the combination of the upper component 200 and the lower component 300 are made of 10% glass-filled high impact polymer combined with the insert 400 made of heat treated 4140 steel results in a cartridge that is approximately 50% lighter than a brass formed counterpart. This weight savings in the unloaded cartridge produces a loaded cartridge of between 25%-30% lighter than the loaded brass cartridge depending on the load used, i.e. which bullet, how much powder, and type of powder used.

The upper component 200 includes a body 202 which transitions into a shoulder 204 that tapers into a neck 206 having a mouth 208 at a first end 210. The upper component 200 joins the lower component 300 at an opposite, second end 212. The lower component 300 joins the upper component 200 at a lower component first end 302 (see FIG. 6). The upper 200 and lower 300 components are adhered by an ultraviolet (UV) light or heat cured resin, a spin weld, a laser weld or an ultrasonic weld.

At a second end 304 of the lower component 300, the lower component is joined to the insert 400. In one example, the upper component 200 and the lower component 300 are molded in separate molds. When the lower component 300 is molded, it is molded over the insert 400. This is a partial molding over, since the lower component 300 does not completely cover the insert 400.

A back end 402 of the insert 400 is also the rear end of the casing 100. The insert 400 is formed with an extraction groove 404 and a rim 406. The groove 404 and rim 406 are dimensioned to the specific size as dictated by the caliber of the ammunition. The insert 400 can be formed by turning down bar stock to the specific dimensions or can be cold formed.

Figure 3:
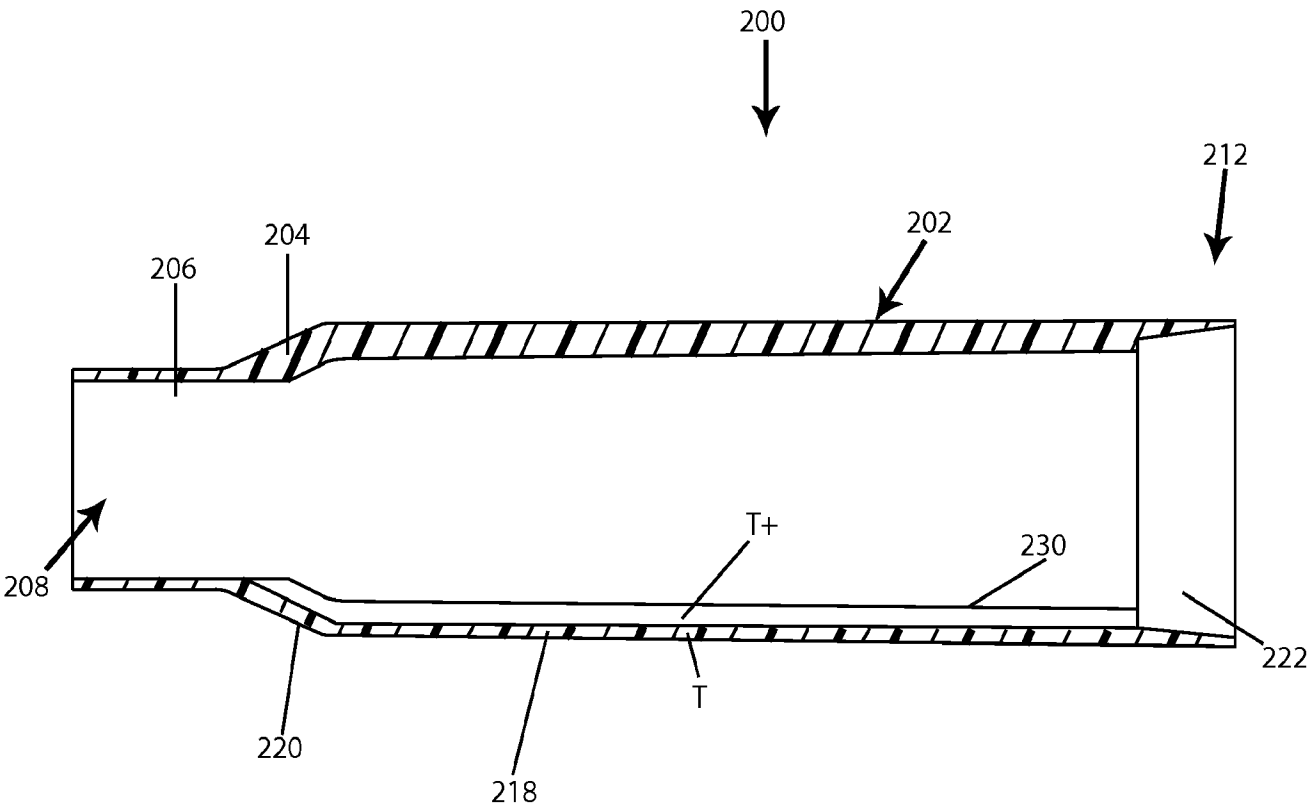
FIG. 3 is a longitudinal cross-section of the upper component of the cartridge.

Turning now to FIG. 3, a cross-section of the upper component 200 is illustrated. Because of the nature of the polymer, and the design of the neck 206 and mouth 208, the neck 206 expands uniformly under the gas pressures formed during firing. This concentric expansion provides a smoother release of the projectile into the barrel of the firearm. The smoother release allows for a more stable flight of the projectile, providing greater accuracy and distance with the same amount of powder.

Moving toward the second end 212 of the upper component 200, as the neck 206 transitions into the shoulder 204, a sleeve 230 begins. The sleeve 230, in this example, extends approximately to the second end 212. The sleeve 230 can be an additional thickness to a wall 218 as is normally required for a standard cartridge, or a separately manufactured and adhered to the wall 218. The sleeve 230 provides additional strength relative to the wall 218 of the body 202 alone. This strengthening, which is in the lateral direction, reduces bending of the upper component 200 of the cartridge case 100. The sleeve 230 helps to keep the cartridge 100 as concentric as possible, and as noted above, concentricity is a key to accuracy.

The case wall 218 can have a thickness T, and the sleeve 230 can have a thickness T+, as illustrated in FIG. 4. Thus, the total thickness of the cartridge at the point where there is the wall 218 and sleeve 230 is the sum of T and T+.

Figure 1A:
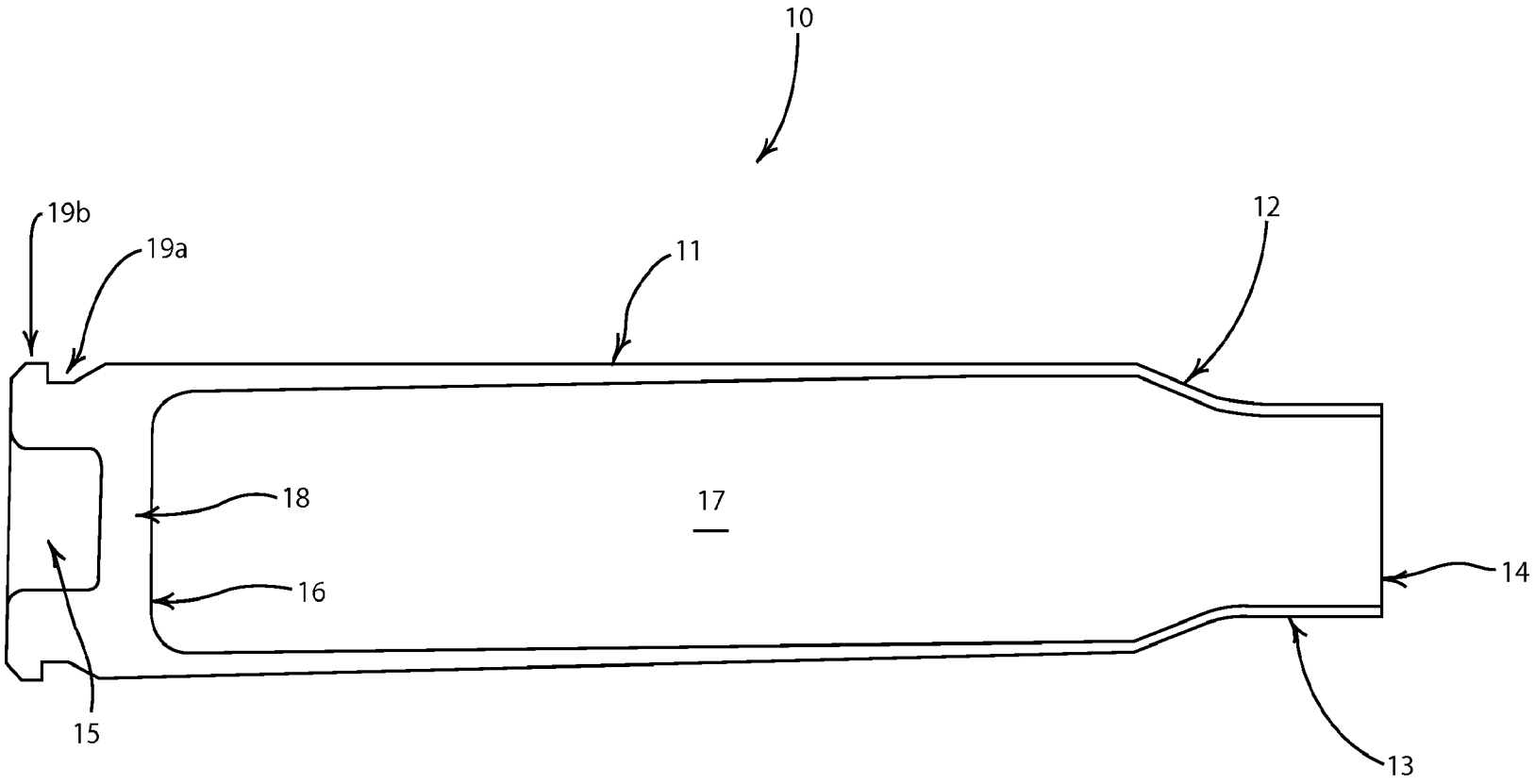
Fig. 1A Prior Art
FIG. 1A is a cross sectional view of a conventional bottleneck cartridge case.
Figure 1B:
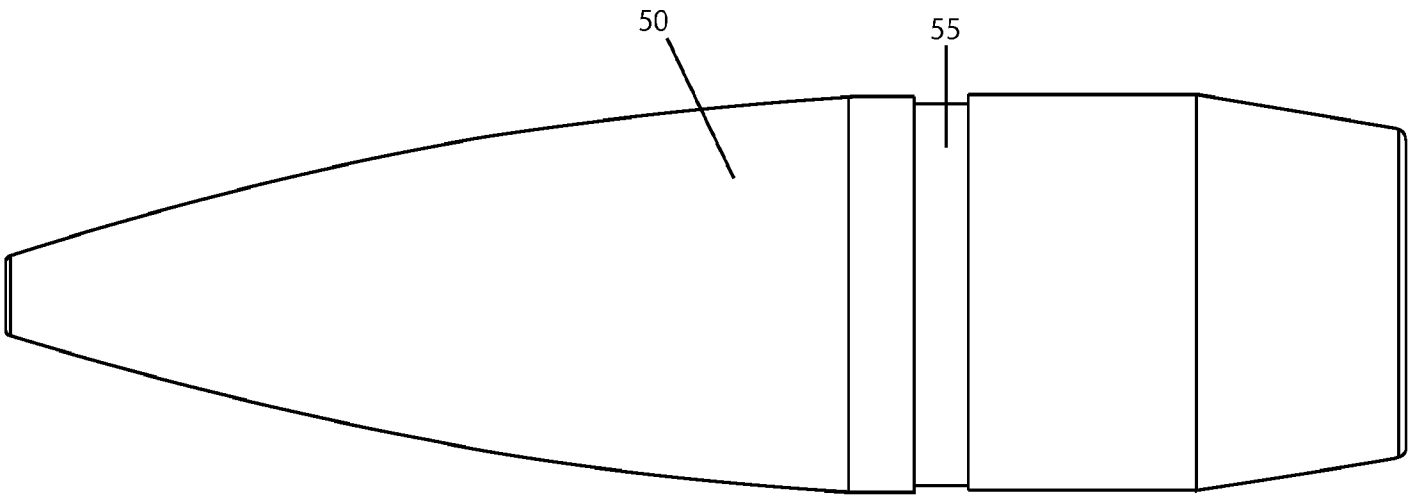
Fig. 1B Prior Art
FIG. 1B is a side view of a conventional bullet.

The upper portion 220 of the sleeve 230 can begin in or near the neck 206 and extend over the shoulder 204. In one example, the upper portion 220 of the sleeve 230 ends against a bullet 50 (see FIG. 1B) providing additional material, and thus strength, to help retain and align the bullet 50. This thickened upper portion 220 can act like an extension of the neck 206 farther down into the shoulder. The upper portion 220 is an advantage over a brass cartridge, since brass cannot be formed in this way. Thus, the upper portion 220 can act to sit and secure the bullet in the same place in the cartridge every time.

The sleeve 230, in the illustrated example of FIGS. 3, 4 and 5, extends almost the entire length of the body 202. The sleeve 230 stops at an overlap portion 222 of the upper component 200. The overlap portion 222 is the portion of the upper component 200 that engages the lower component 300. The overlap portion 222 has a thinner wall thickness t, or a second thickness, at the second end 212 than the thickness T of the wall 218 (or T and T+) before the overlap portion 222. The second thickness t tapers toward the outside of the upper component 200 so an outer diameter 224 of the wall 218 remains constant while an inner diameter 226 of the wall 218 increases. This allows certain examples of cartridge 100 to maintain a constant outer diameter from below the shoulder 204 to the insert 400. The bottom end 228 of the sleeve 230 is approximately squared off to provide a square shoulder to keep the upper 200 and lower 300 components concentric during assembly.

Figure 6:
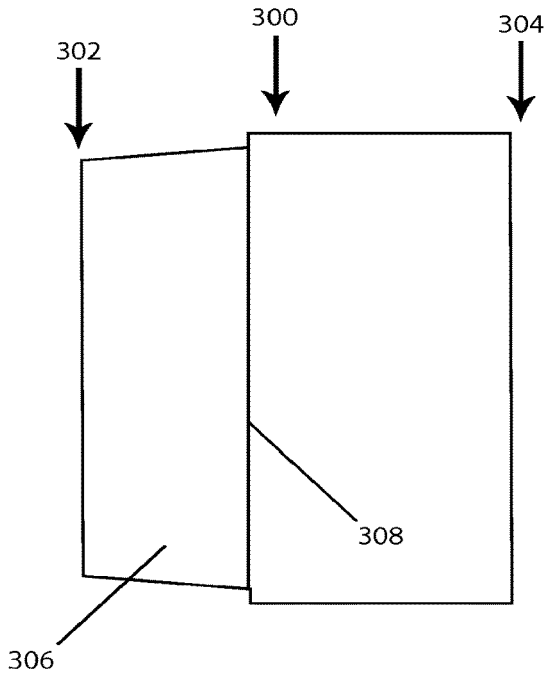
FIG. 6 is a side view of the lower component without the upper component and insert.
Figure 7:
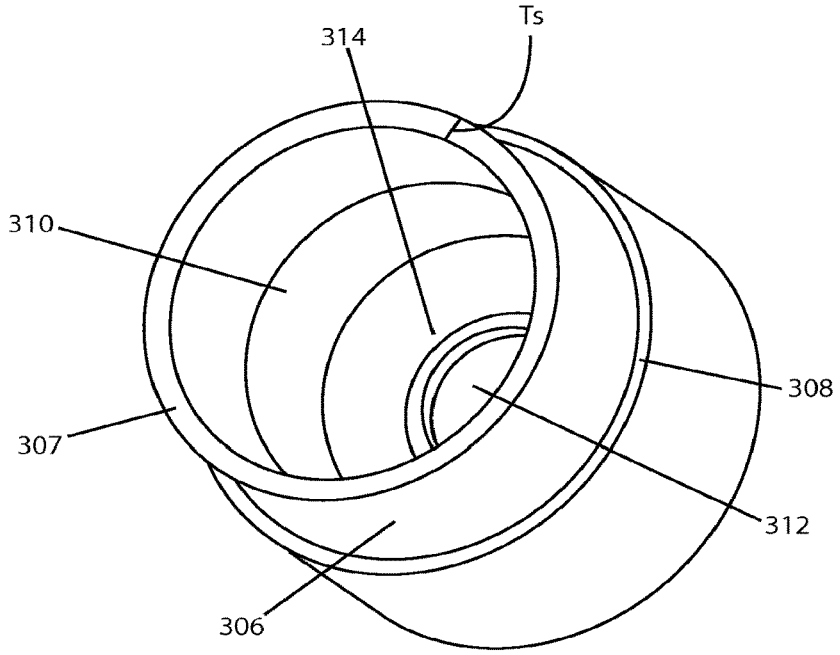
FIG. 7 is a bottom front perspective view of the lower component of FIG. 6.
Figure 8:
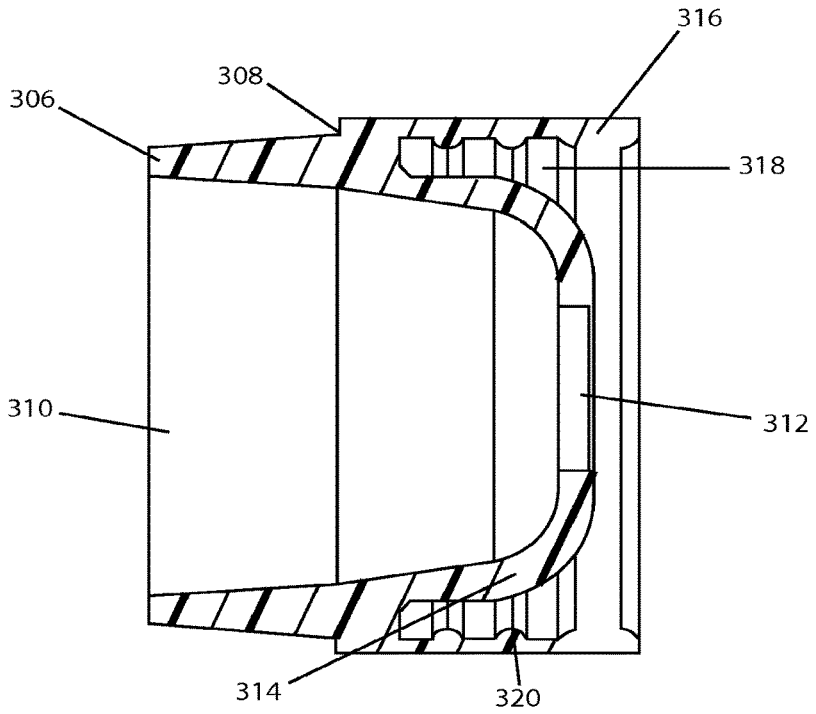
FIG. 8 is a longitudinal cross-section view of the lower component of FIG. 6.

FIGS. 6-8 illustrate that the lower component 300 has a tapered portion 306 starting at the lower component first end 302 and ending at a collar 308. The slope of the tapered portion 306 approximately matches the slope of the overlap portion 222 so the two can slide over each other to engage the upper 200 and lower 300 components. The tapered portion 306 ends in a flat seat 307. The seat 307 can have a thickness Ts which is about equal to the thickness of the wall and/or sleeve. This allows the bottom end 228 of the sleeve to sit on the seat 307 when the upper 200 and lower 300 components engage. This prevents the bottom end 228 of the sleeve 230 from being exposed. This could allow the gases to exert pressure on the bottom end 228 that can separate the upper 200 from the lower 300 component.

A width of the collar 308 matches the second thickness t, so that the outer diameter of the cartridge 100 remains constant past the transition point between the upper 200 and lower 300 components. Further, a thickness of the tapered portion 306 is such that at any point the sum of it with the thickness of the overlap portion 222 is approximately equal to the thickness T of the wall 218 or the thicknesses of the wall 218 and sleeve 230 (T and T+). As noted above, the tapered portion 306 and the overlap portion 222 are bonded together to join the upper 200 and lower 300 components.

An inner wall 310 of the lower component 300 can be formed straight. In the illustrated example in FIG. 8, the inner wall 310 forms a bowl shape with a hole 312 at the bottom. The hole 312 is formed as a function of the interface between the lower component 300 and the insert 400, and its formation is discussed below. As the inner wall 310 slopes inward to form the bowl shape, it forks and forms an inner bowl 314 and an outer sheath 316. The gap 318 that is formed between the inner bowl 314 and the outer sheath 316 is the space where a portion of the insert 400 engages the lower component 300. As noted above, in one example, the lower component 300 is molded over a portion of the insert 400 to join the two parts.

Figure 9:
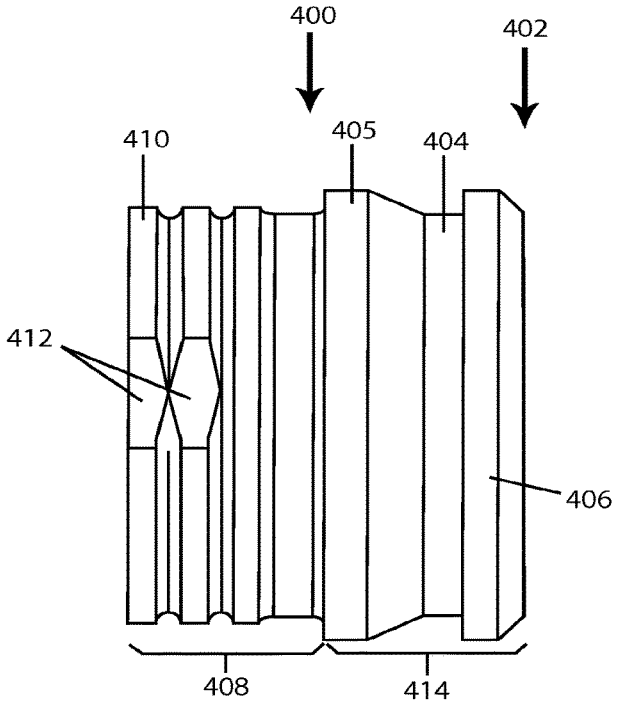
FIG. 9 is a side view of the insert without the upper and lower components.

Turning now to an example of the insert 400, as illustrated in FIG. 9, it includes an overmolded area 408, where the outer sheath 316 engages the insert 400 in the gap 318. The overmolded area 408 has one or more ridges 410. The ridges 410 allow the polymer from the outer sheath 316, during molding, to forms bands 320 (see, FIG. 8) in the gap 318. The combination of the ridges 410 and bands 320 aid in resisting separation between the insert 400 and the lower component 300. The resistance is most important during the extraction of the cartridge from the firearm by an extractor (not illustrated).

The overmolded area 408 also includes one or more keys 412. The keys 412 are flat surfaces on the ridges 410. These keys 412 prevent the insert 400 and the lower portion 300 from rotating in relation to one another, i.e. the insert 400 twisting around in the lower portion 300.

Below the overmolded area 408, toward the back end 402, is a self-reinforced area 414. This portion extends to the back end 402 of the insert 400 and includes the extraction groove 404 and rim 406. The self-reinforced area 414 must, solely by the strength of its materials, withstand the forces exerted by the pressures generated by the gasses when firing the bullet and the forces generated by the extractor. In the present example, the self-reinforced area 414 withstands these forces because it is made of a heat treated metal or a metal/non-metal alloy.

Figure 10:
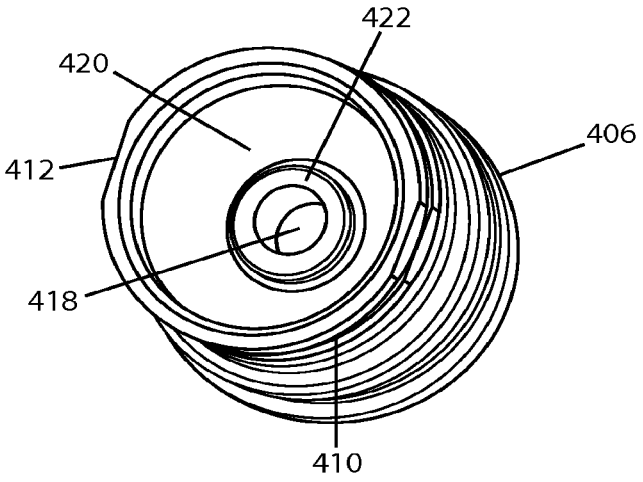
FIG. 10 is a bottom front perspective view of the insert of FIG. 8.
Figure 11:
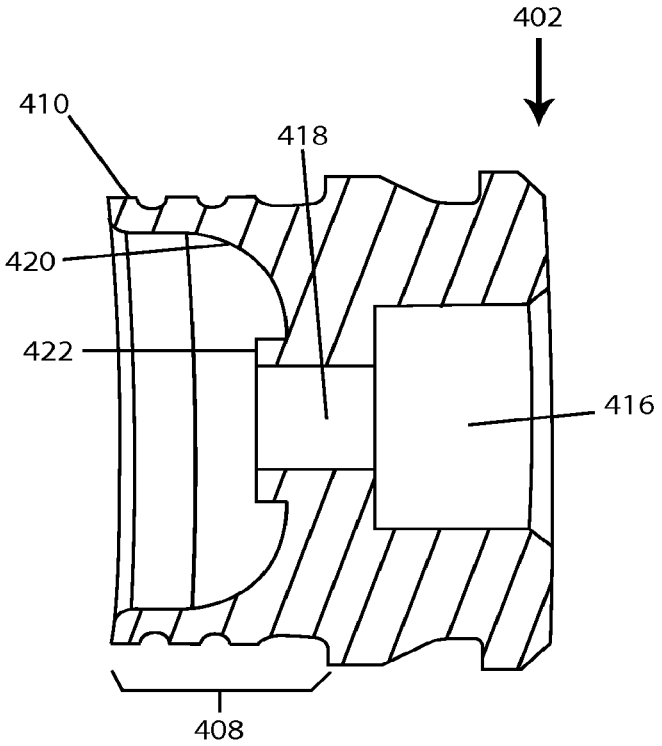
FIG. 11 is a longitudinal cross-section view of the insert of FIG. 8.

FIGS. 10 and 11 illustrate an example of the inside of the insert 400. Open along a portion of the back end 402 and continuing partially toward the overmolded area 408 is a primer pocket 416. The primer pocket 416 is dimensioned according to the standards for caliber of the cartridge case and intended use. A primer (not illustrated) is seated in the primer pocket 416, and, as described above, when stricken causes an explosive force that ignites the powder (not illustrated) present in the upper 200 and lower 300 components.

Forward of the primer pocket 416 is a flash hole 418. Again, the flash hole 418 is dimensioned according to the standards for the caliber of the cartridge case and intended use. The flash hole 418 allows the explosive force of the primer, seated in the primer pocket 418, to communicate with the upper 200 and lower 300 components.

Forward of the primer pocket 416 and inside the overmolded area 408 is basin 420. The basin 420 is adjacent to and outside of the inner bowl 314 of the lower component 300. The basin 420 is bowl shaped, wherein the walls curve inwards toward the bottom. The bottom of the basin 420 is interrupted by a ring 422. The ring 422 surrounds the flash hole 418 and extends into the basin 420. It is the presence of the ring 422 that forms the hole 312 in the inner bowl 314 of the lower component 300.

Figure 12:
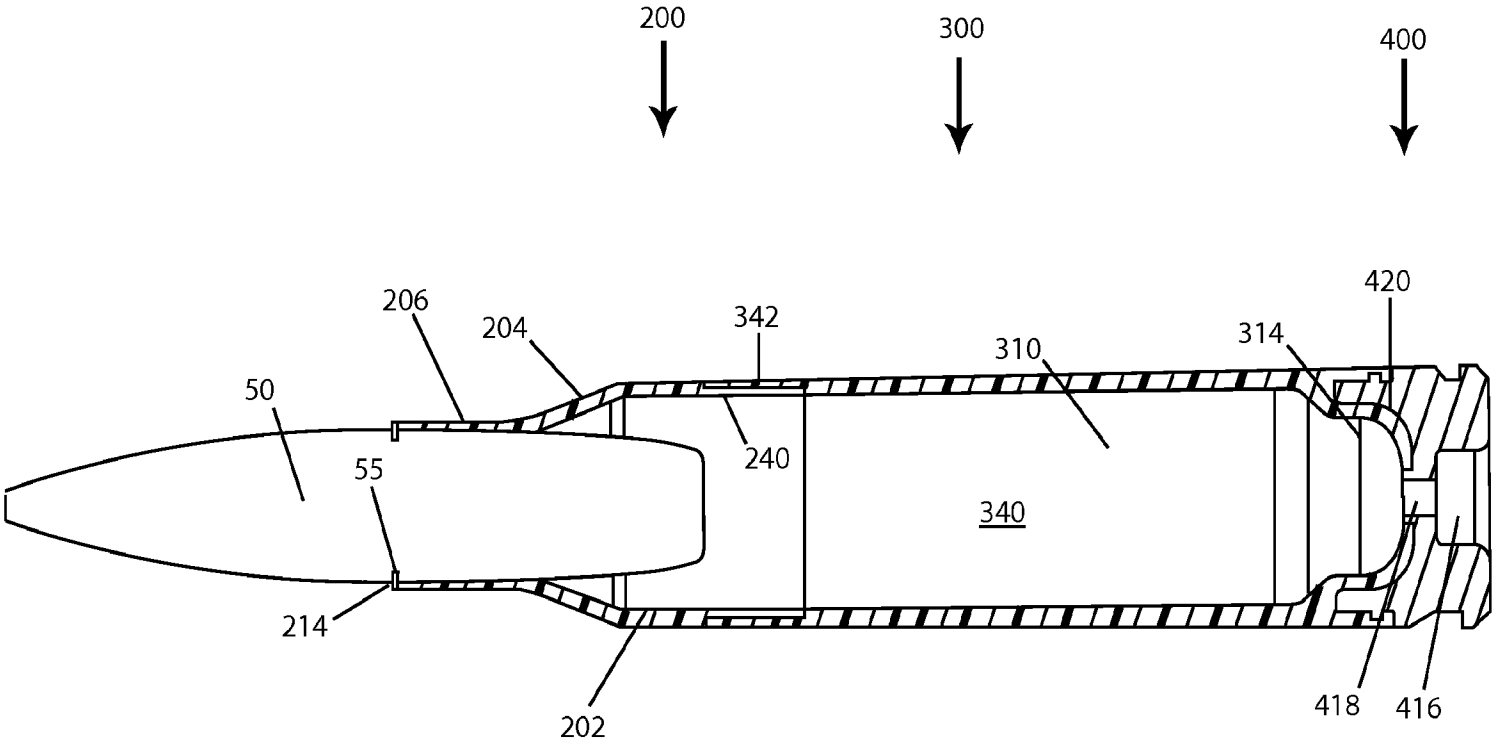
FIG. 12 is a longitudinal cross-section view of an example of a cartridge case.

In another example of a cartridge case 120, the sizes of the upper 200 and lower 300 components can be altered. FIG. 12 illustrates a "small upper" embodiment with a bullet 50 in the mouth 208 of the cartridge 120. The features of the upper 200 and lower 300 component are almost identical to the example discussed above, and the insert 400 can be identical. FIG. 12 also illustrates the engagement between a lip 214 and the cannelure 55. The lip 214 is a section of the neck 206 approximate to the mouth 208 that has a thicker cross section or, said differently, a portion having a smaller inner diameter than the remainder of the neck 206. In this example, the lip 214 is square or rectangular shaped, no angles or curves in the longitudinal direction. Note, in other examples, the upper component 200 is not formed with a lip 214. When present, the lip 214 engages the cannelure 55 formed along an outer circumferential surface of the bullet 50 when it is fitted into the mouth 208 of the cartridge casing 100.

Figure 13:
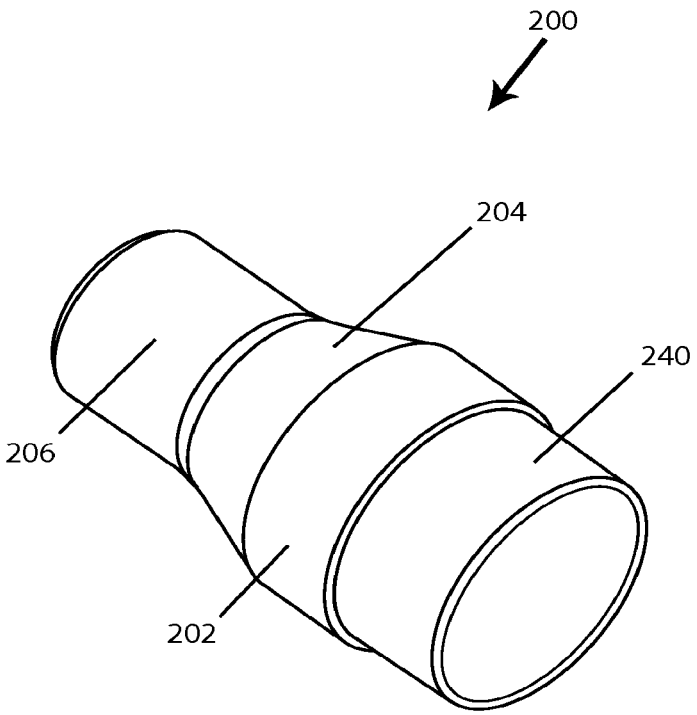
FIG. 13 is a top, side, perspective view of the upper component of the example.

FIG. 13 shows that the neck 206 and the shoulder 204 are formed similar, but in this example, the body 202 is much shorter. Further, instead of an overlap portion 222, there is an underskirt portion 240 that starts very close to the shoulder 204. The underskirt portion 240 tapers to the inside of the cartridge when it engages the lower component 300.

The lower component 300 in this further example, is now much longer and comprises most of the propellant chamber 340. The tapered portion is now replaced with an outer tapered portion 342. The outer tapered portion 342 slides over the underskirt portion 240 so the two can be joined together as noted above. The thickness of the underskirt portion 240 and the outer tapered portion 342 is approximate to the wall thickness or wall thickness and sleeve thickness.

Figure 14:
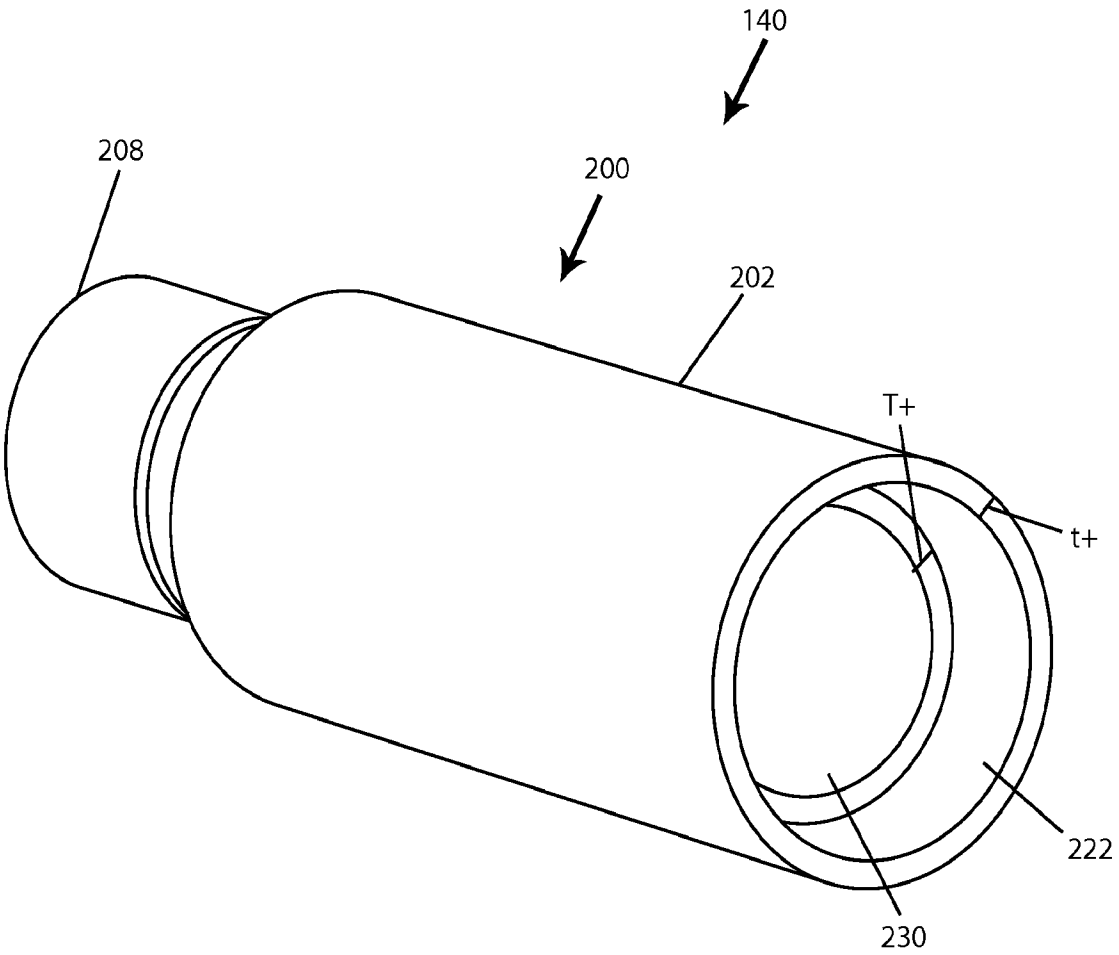
FIG. 14 is a top, side perspective view of an example of an upper component of a subsonic cartridge.

The inner wall 310 is now substantially longer, can include a sleeve, but still ends in the inner bowl 314. The engagement between the second end 304 of the lower component 300 and the insert 400 remains the same. Note that either the "small upper" or "long upper" can be used to form blank or subsonic ammunition. The walls are made thicker with the sleeve, shrinking the size of the propellant chamber 340. Less powder can be used, but the powder is packed similarly as tight as it is for a live round because of the smaller chamber 340. This can prevent the Secondary Explosive Effect (SEE) (below). A thick wall design for a subsonic cartridge 140 is illustrated in FIG. 14.

Illustrated is a large upper component 200 having a thicker overlap 222 portion, with a thickness t+ and an integral thickening of the wall, and/or a sleeve 230 with a thickness T+, as disclosed above. The total thickness of the wall 218 can be the sum of T+ and t+. The sleeve 230 can run the length of the upper component 200 from the mouth 208 to the start of the overlap portion 222. The lower component 300 of a subsonic cartridge 140 can be thickened as well. The subsonic cartridge 140 can be made with the insert 400, or the lower component 300 can be molded in one piece from polymer with the features of the insert 400. For example, the flash hole 418, primer pocket 416, groove 404 and rim 406. Alternately, the insert can also be high-strength polymer instead of the metal alloys discussed above. In this example, the lower component and the insert can be formed as one piece, and the upper component 200 can be placed on top.

Figure 15:
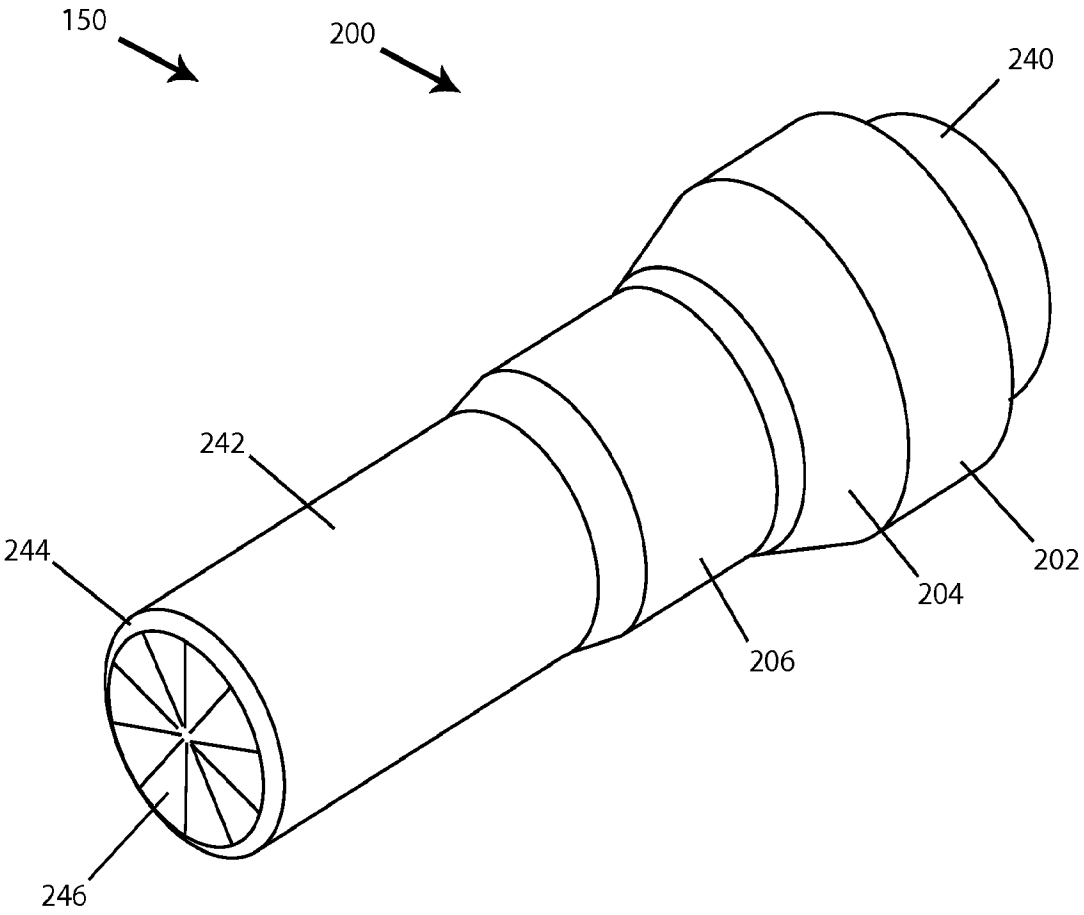
FIG. 15 is a top, side perspective view of an upper component for a blank cartridge.

As illustrated in FIG. 15, for a blank cartridge 150, the upper component 200 can be made differently. For the blank cartridge 150, an extension 242 can be molded to extend from the neck 206. The extension 242 has a star-shaped cap 244 to seal off the cartridge. The cap 244 is formed partially of radially spaced fingers 246 that deform outwards during firing. Thus, the mouth 208 is molded partially shut to contain a majority of the pressures and expand open and outwards. The fingers 246 are designed, in one example, to be bend elastically and are not frangible. The object is to contain the majority of the pressures and expel anything that can act as a projectile out the barrel of the firearm.

When the blank cartridge 150 is formed with the "small upper" component 200 with the cap 244. The lower component 300 can be filled with the powder and the small upper component can act as a cap to the cartridge, sealing in the powder.

Figure 16:
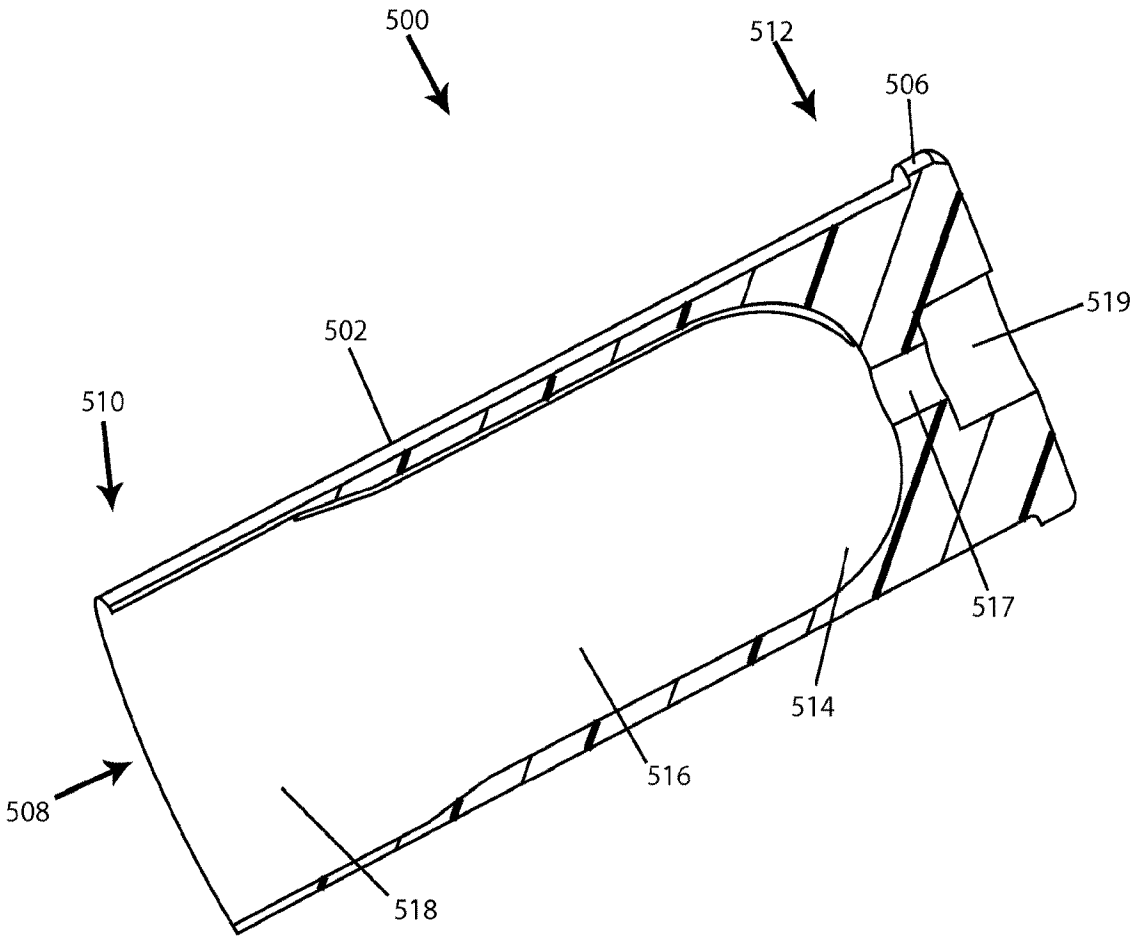
FIG. 16 is a longitudinal cross-section view of an example of a straight wall cartridge case.

Note that the above examples illustrate a bottleneck cartridge. Many of the features above can be used with any cartridge style, including straight wall cartridges used in pistols. FIG. 16 illustrates an example of a straight wall cartridge 500. The straight wall cartridge 500 is a one-piece design of all polymer. The cartridge 500 has a body 502 and a mouth 508 at a first end 510. The walls 518 of the cartridge casing can also have a sleeve 530 along a majority of its length.

The sleeve 230, 530 is dimensioned and shaped pursuant to the requirements of each cartridge based on blank or subsonic and the particular caliber. To that end, the sleeve 530 begins set back from the first end 510 based on the depth the rear of the bullet sits in the cartridge. Further, in this example, as the walls transition into a lower bowl 514, the sleeve 530 may extend into the bowl. This aids in the strength of a back end 512 of the cartridge 500, since this example lacks a hardened metal insert.

The lower bowl 514 curves downward toward a flash hole 517 which then opens to a primer pocket 519. Both are similar to the features described above. Further, the back end is molded to form a rim 506.

Figure 17:
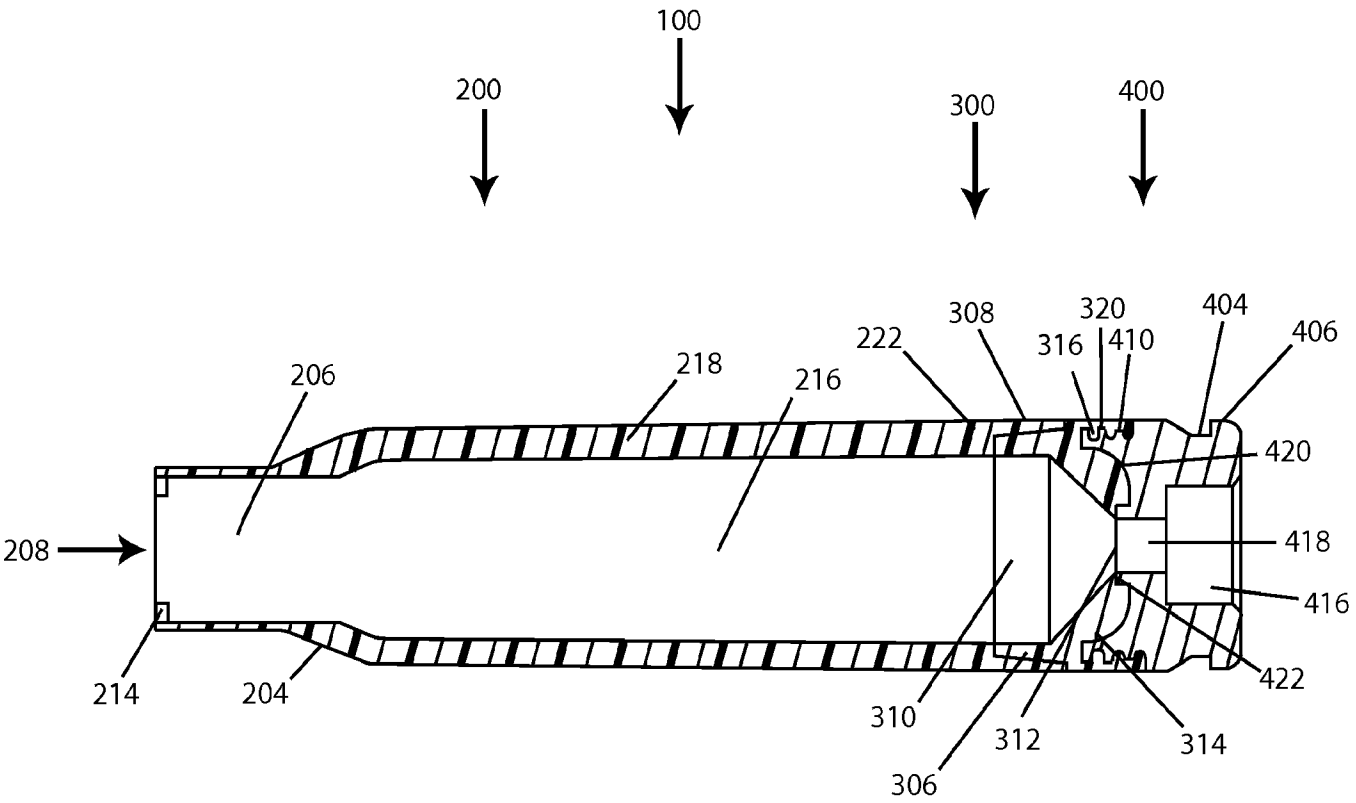
FIG. 17 is a longitudinal cross-section view of the cartridge case of FIG. 2.

Turning now to an example of a fully formed cartridge case 100, FIG. 17 illustrates a cross-section of all three elements engaged together to illustrate how they interface with each other. The specific outer dimensions of the three elements and certain inner dimensions (e.g. mouth 208, lip 214, flash hole 418, and primer pocket 416) are dictated by the caliber and type of the firearm and type of ammunition. The cartridge casing 100 of the present invention is designed to be used for any and all types of firearms and calibers, including pistols, rifles, manual, semi-automatic, and automatic firearms.

An exemplary construction of the upper component 200 also aids in withstanding the pressures generated. As noted above, the sleeve 230 increases the strength of the wall 218 of the upper component 200. In the present example, the upper component 200 accounts for anywhere from 70% to 90% of the length of the cartridge casing 100.

The polymer construction of the cartridge case also provides a feature of reduced friction between the cartridge and chamber of the firearm. Reduced friction leads to reduced wear on the chamber, further extending its service life.

Figure 18:
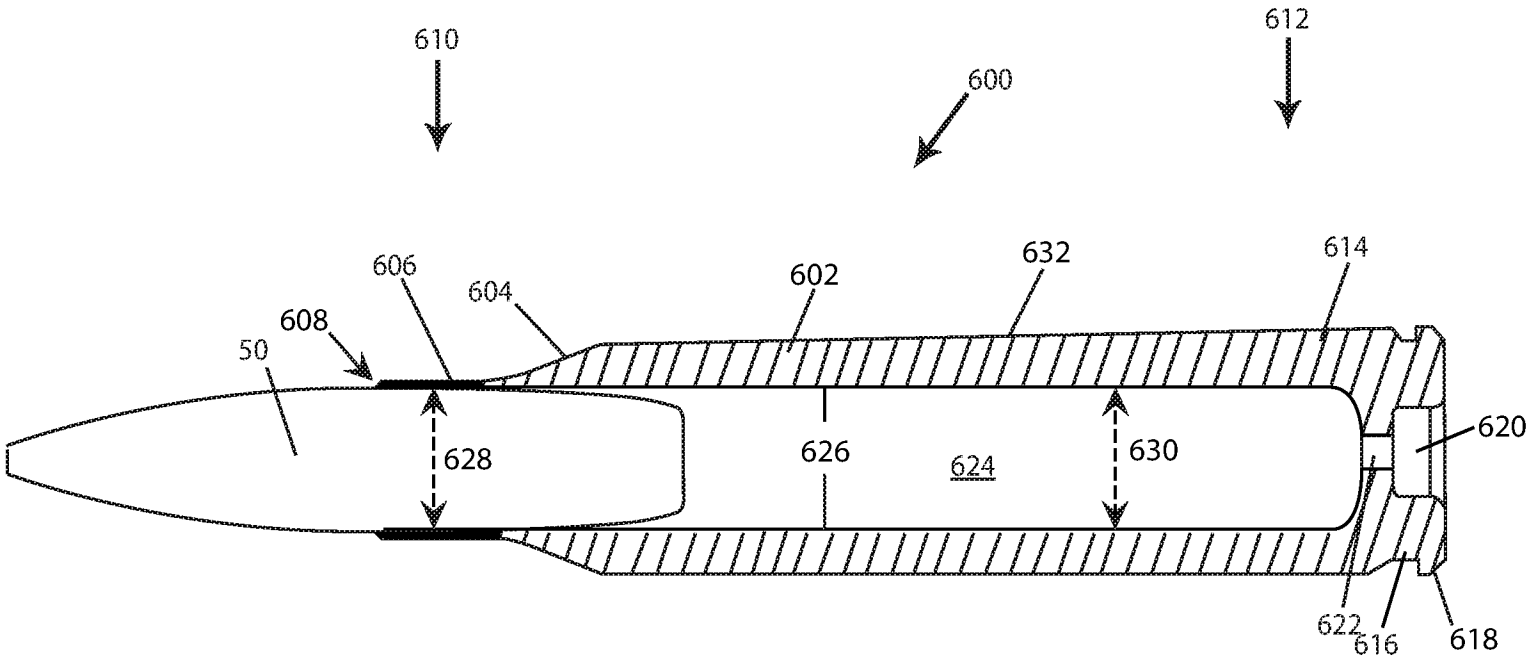
FIG. 18 is a longitudinal cross-section view of an example of a one-piece blank or subsonic cartridge case.

Turning now to FIG. 18, an example of a one-piece subsonic cartridge casing 600 is illustrated. In this example, the entire cartridge casing 600 is polymer. The subsonic cartridge casing 600 includes a body 602 which, at a first end 610 transitions into a shoulder 604 that tapers on the outside into a neck 606 having a mouth 608. The bullet 50 can be inserted into the mouth 608 of the subsonic cartridge casing 600.

Opposite the first end 610 is second end 612. A back end 614 is the rear of the second end 612 of the subsonic cartridge casing 600. The back end 614 is formed with an extraction groove 616 and a rim 618. The groove 616 and rim 618 are dimensioned to the specific size as dictated by the caliber of the ammunition. Also, included in the back end 614 is a primer pocket 620. The primer pocket 620 is dimensioned according to the standards for caliber of the cartridge case and intended use. Forward of the primer pocket 620 is a flash hole 622. Again, the flash hole 622 can be dimensioned according to the standards for the caliber of the cartridge case and intended use. The flash hole 622 allows the explosive force of the primer, seated in the primer pocket 620, to communicate with a propellant chamber 624.

In this example, the propellant chamber 624 is formed from the inner wall 626 of the body 602. The inner wall 626 can be straight from the mouth 608 to the back end 214. Thus, a first diameter 628 of the inside of the mouth 608 is approximately equal to a second diameter 630 of the propellant chamber 624. Alternately, or in addition to, the first diameter 628 can be a diameter of the inside of the neck 606.

An outside wall 632 of the body 602 is shaped and dimensioned according to the standards for the caliber of the cartridge case and intended use. This includes the length of the neck, the angle of the shoulders, and length of the total body. A straight inner wall 626 acts to thicken the walls of the cartridge 600, providing the benefits as described above. The thickened walls act to reduce the size of the propellant chamber 624, allowing less powder to be used. In certain examples this can generate lower pressures on ignition and expel the bullet 50 at subsonic speeds.

The straight inside wall 626 example makes for ease of molding. A single "pin" or mandrel can be set to mold a constant diameter from mouth/neck 608, 606 to back end 614. The back end 614 can also be made of polymer. Since examples of the cartridge 600 are designed to generate lower pressures, certain calibers or designs do not require the insert 400, as described above.

In other examples, the subsonic cartridge casing 600 can be either formed from 2 or 3 parts. In one example, the back end 614 is replaced with the overmolded insert 400. In another example, the subsonic cartridge casing 600 can be formed from two pieces, an upper and lower component similar to that described above. However, the components have a constant second diameter 630 between the two. The lower component can be formed either with the insert or without and the back end 614 is polymer.

Figure 19A:
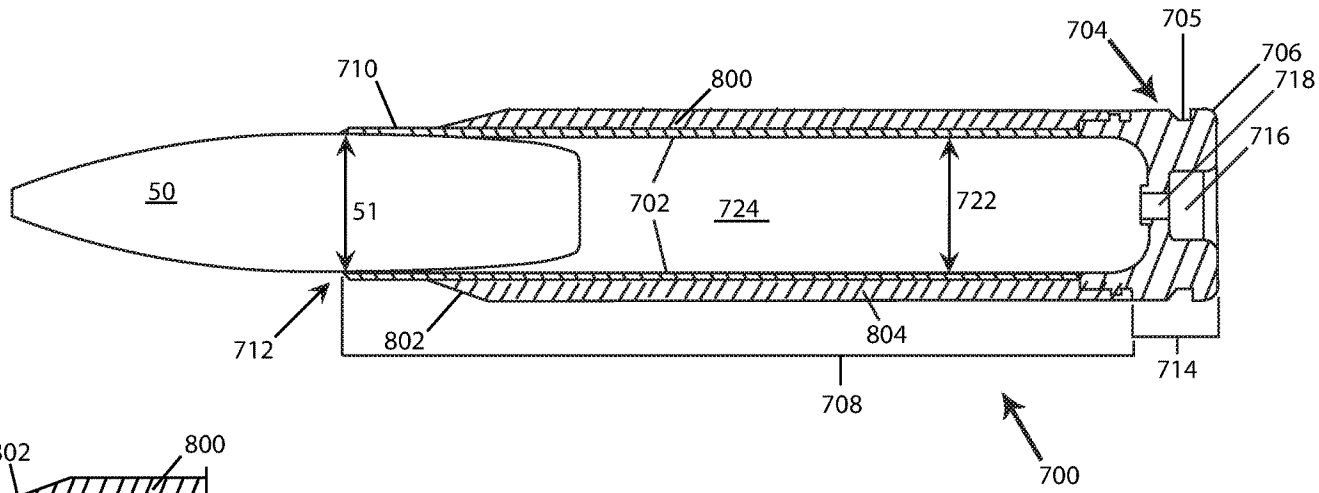
FIG. 19A is a longitudinal cross-section view of an example of a metallic sleeve with a polymer sheath for a blank or subsonic cartridge case.
Figure 19B:
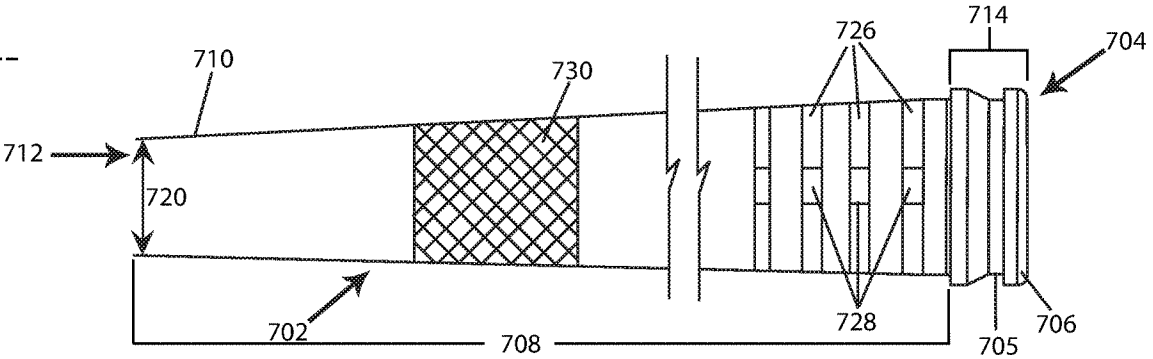
FIG. 19B is a side view of an example of the metallic sleeve of FIG. 19A.

FIGS. 19A and 19B illustrate a further example of a subsonic cartridge 700. In this example, a full metal sleeve 702 extends a significant length of the cartridge 700. The sleeve 702 can have an insert section 704 similar to the insert 400, and the sleeve 702 can act as an integral extension of the insert 400. The insert section 704 can have a self-reinforced area 714 which can include an extraction groove 705 and a rim 706. The groove 705 and rim 706 are dimensioned to the specific size as dictated by the caliber of the ammunition. The insert section can also have a primer pocket 716 and flash hole 718.

Forward of the insert section 704 is sleeve section 708. The sleeve section 708 can extend the length of the cartridge 700 and, in one example, form a neck 710 of the cartridge with a mouth 712 wherein the bullet 50 is fitted into the mouth 712. The mouth 712 can have a mouth diameter 720 sized to receive the bullet 50 and the remaining portion of the sleeve section 708 can have a sleeve diameter 722 approximately equal to the mouth diameter 720. The sleeve section 708 can act as a propellant chamber 724, and the sleeve diameter 722 can be such as to limit the amount of propellant so the bullet 50 can travel at subsonic speeds.

In an example, the sleeve 702 is straight walled and the sleeve diameter 722 approximates a bullet diameter 51. To allow the cartridge 700 to fit in a standard chamber for the particular caliber, the outside of the sleeve 702 is molded with a polymer sheath 800. The polymer sheath 800 can be molded to the true dimensions of the cartridge for the particular caliber, including a shoulder 802 and outside wall 804. Multiple ridges 726 can be formed in the sleeve section 708 to allow the polymer from the polymer sheath 800, during molding, to forms bands (not illustrated and as above). The combination of the ridges 726 and bands aid in resisting separation between the sleeve 700 and the polymer sheath 800. The resistance can be most important during the extraction of the cartridge from the firearm by an extractor (not illustrated).

The ridges 726 can also include one or more keys 728. The keys 728 are flat surfaces on the ridges 726. The keys 728 prevent the sleeve 702 and the polymer sheath 800 from rotating in relation to one another, i.e. the sleeve 702 twisting around in the polymer sheath 800. Instead of, or in conjunction with, the ridges 726, the sleeve 702 can have knurling or texturing 730 to prevent the relational rotation.

Figure 19C:
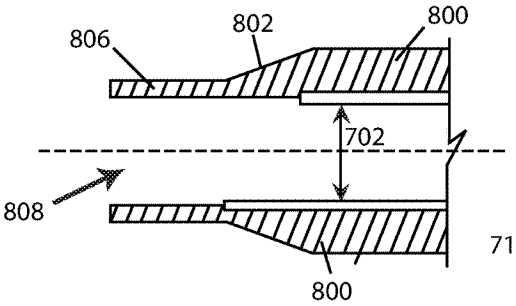
FIG. 19C is a partial split longitudinal cross-section view of an example of a polymer neck with the metallic sleeve.

In other examples, the sleeve section 702 does not extend the length of the cartridge 700. The sleeve section 702 can stop at or before the molded shoulder 802. In this example, the polymer sheath 800 can form a polymer neck 806 and polymer mouth 808 to receive the bullet 50. See FIG. 19C.

The sleeve 702 can be metal and formed by turning down bar stock to the specific dimensions or can be cold formed. Further, it can be a different metal than the insert section 704. The goal is to create a lightweight cartridge using the strength of the metal sleeve and the low weight, high strength properties of polymers. Using more polymer than metal assists in the weight to strength ratio. The polymer sheath 800 can be made of the same polymers discussed above or other polymers of lower strength, owing to the metallic support of the sleeve 702. The metals can be any known metals that can provide light weight strength under exploding propellant conditions. This includes brass, aluminum, steel or other alloys. Further, ceramics or other materials may also be used.

Figure 20A:
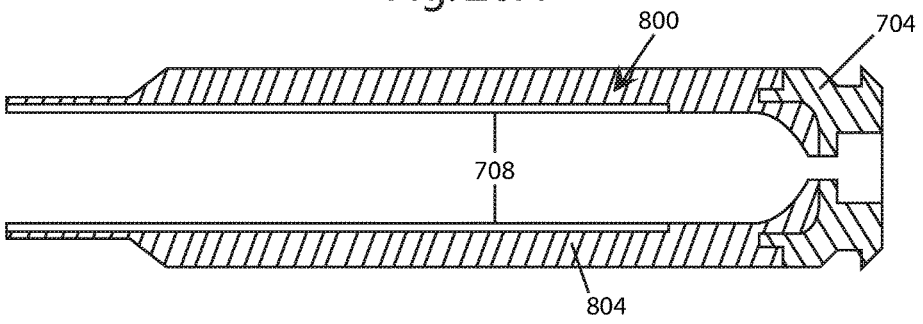
FIG. 20A is a longitudinal cross-section view of an example of a two-part metallic sleeve with a one-piece blank or subsonic cartridge case.
Figure 20B:
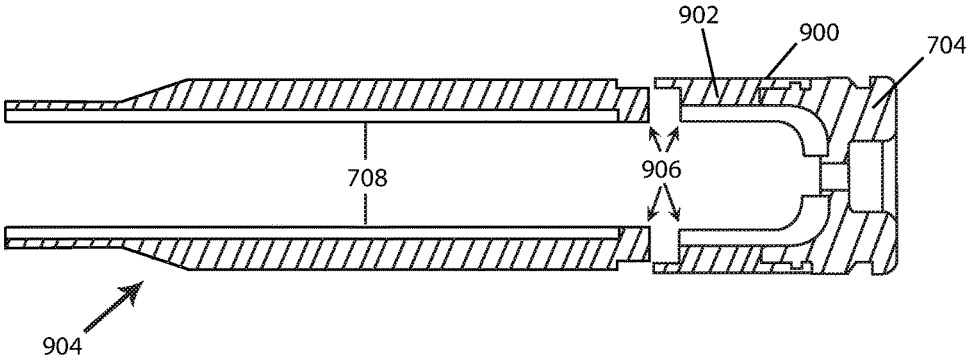
FIG. 20B is a longitudinal cross-section view of an example of a two-part metallic sleeve with a two-piece blank or subsonic cartridge case.
Figure 20C:
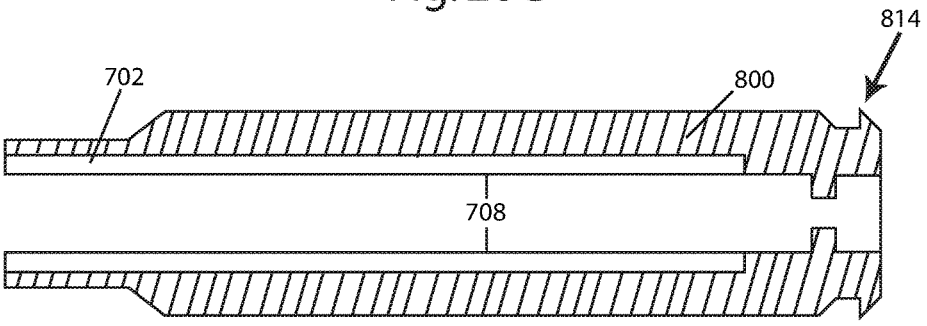
FIG. 20C is a longitudinal cross-section view of an example of a one-part metallic sleeve with a one-piece blank or subsonic cartridge case.

In one example, the sleeve 702 can be a brass cartridge from a different caliber (typically smaller) that receives a polymer sheath to fit in a larger caliber chamber. The brass cartridge can also be cut or stretched to accommodate the larger caliber bullet and the particular length required of the cartridge. Note that in a further example, the sleeve 702 can have sloped shoulders and the shoulders can remain exposed or sheathed in polymer. In other examples, the insert section 704 and the sleeve section 708 are not integral. They can be separated and molded as one piece, as in FIG. 20A. Alternately, the examples above can have a lower component 900 of polymer 902 and the insert section 704 polymer welded to an upper component 904 of polymer and sleeve section 708. The upper and lower components 900, 904 can have a mating overlap/underskirt/taper section 906, as described above. Either component 900, 904 can have an overlap or underskirt portion and the opposite component 900, 904 can have the mating taper portion. See FIG. 20B. The lower and upper components 900, 904 can be similar to the lower and upper components described above in assembly and size. FIG. 20C illustrates the sleeve 702 without the insert section 704, only the sleeve section 708. In this example, the polymer sheath 800 forms a back end 814, similar to the polymer back end 614 described above.

Figure 21:
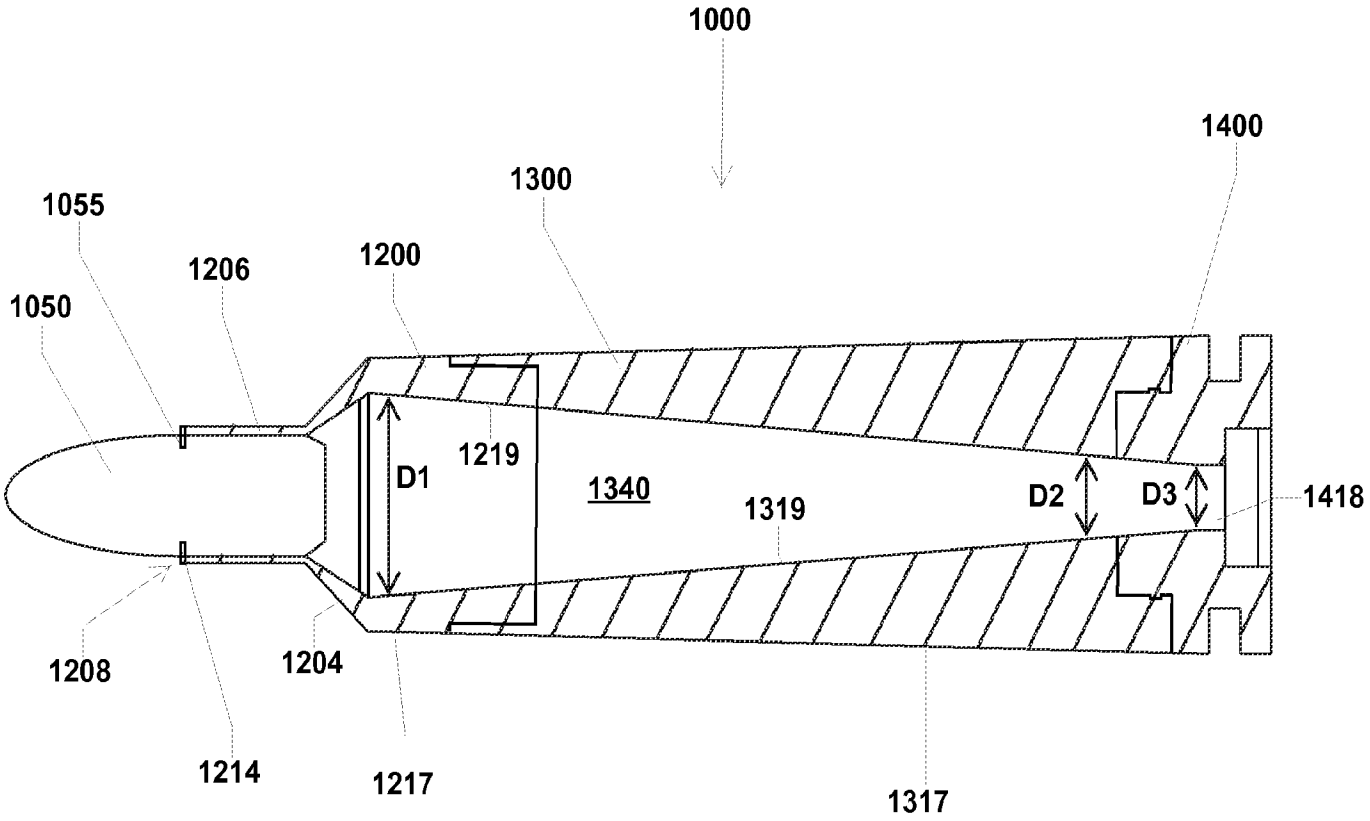
FIG. 21 is a longitudinal cross-section view of an example of a tapered wall cartridge case.
Figure 22:
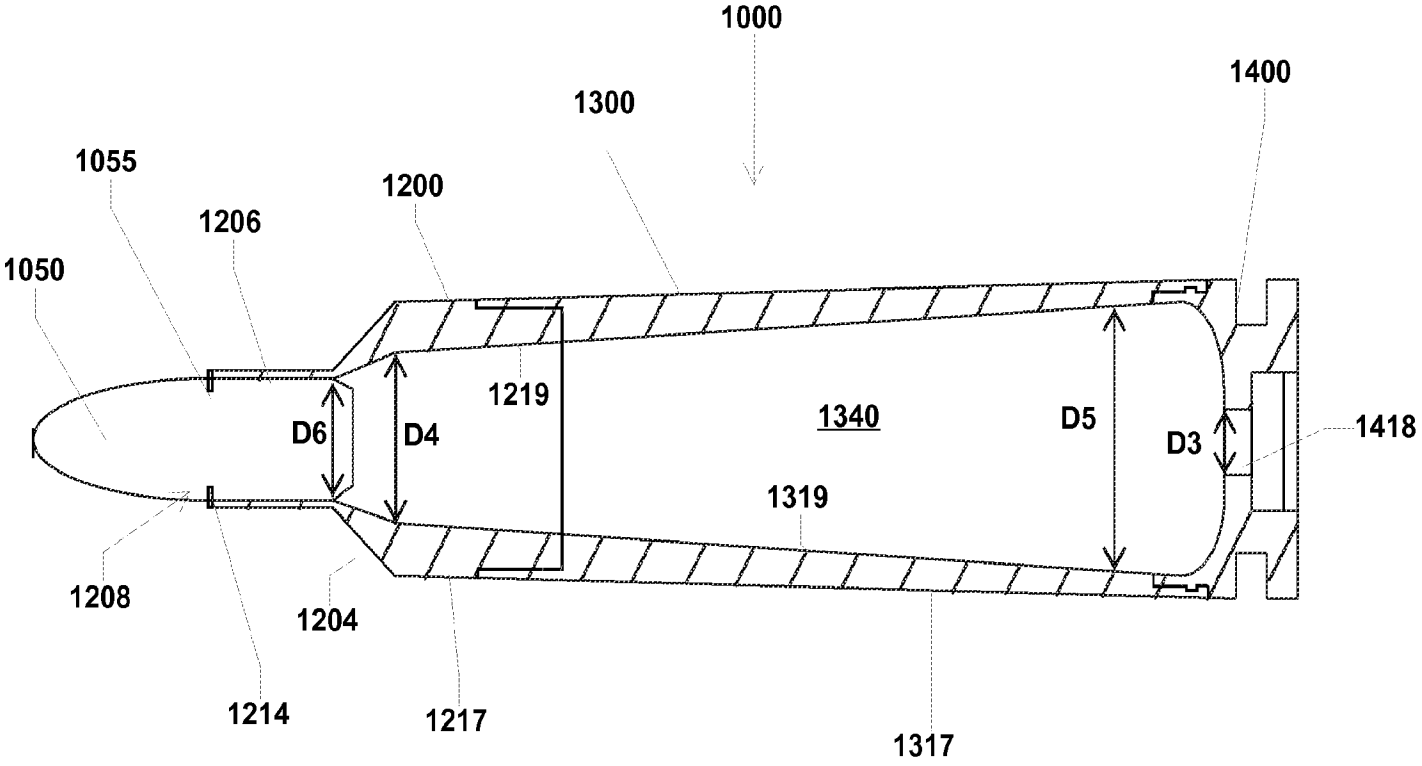
FIG. 22 is a longitudinal cross-section view of another example of a tapered wall cartridge case.

Additional examples of reduced capacity cartridge cases are illustrated in FIGS. 21 and 22. FIG. 21 illustrates a lower narrowed cartridge 1000. The lower narrowed cartridge 1000 includes an upper component 1200 of the lower narrowed cartridge, a lower component 1300 of the lower narrowed cartridge and an insert 1400 for the lower narrowed cartridge. The upper, lower, and insert 1200, 1300, 1400 are generally formed as above, except as described further below. The upper component 1200 has a mouth 1208 in which a bullet 1050 is inserted. The mouth 1208 is an opening in the neck 1206 of the upper component 1200 and can also contain a lip 1214. The lip 1214 can engage a cannelure 1055 in the bullet 1050.

Further, at least one the lip 1214 and the cannelure 1055 can be replaced with an adhesive (not illustrated). The adhesive can seal the bullet 1050 in the neck 1206 and provide a waterproofing feature, to prevent moisture from entering between the bullet 1050 and the neck 1206. The adhesive also provides for a control for the amount of force required to project the bullet 1050 out of the cartridge 1000. Controlling this exit force, in certain examples, can be important, since the bullet for sub-sonic ammunition is already "under powered" in relation to a standard round.

The bullet 1050 is a standard weight bullet for its particular caliber. The "standard weight" or common weight for a projectile varies slightly. Some examples of standard weights can include at .223 (5.56) caliber weights between 52 and 90 grains; at .308 and .300 Winchester Magnum calibers weights between 125 and 250 grains; and for .338 Lapua® Magnum caliber weights between 215 and 300 grains. This can also include standards weights for .50 caliber between 606 and 822 grains. The bullet 1050 can be less than 125% of maximum standard weight for a particular caliber. Further, the bullet can be less than 120%, 115%, 110% and 105% of the caliber's maximum standard weight.

The upper component 1200 can also include a shoulder 1204. The shoulder 1204 slopes outward from the neck 1206 and then straightens out to form the upper component outer wall 1217. The upper component 2100 can join the lower component 1300 as described above, and the lower component 1300 also can have a lower component outer wall 1317. The upper and lower component outer walls 1217, 1317 can form the outer shape of the cartridge and are shaped as such to fit a standard chamber for the particular caliber.

Both the upper and lower components 1200, 1300 can have inner walls 1219, 1319, respectively. The inner walls 1219, 1319 can form the propellant chamber 1340, which contains the powder or other propellant to discharge the bullet 1050 from the weapon (not illustrated). The inner walls 1219, 1319, in this example, can be angled to form a constant slope toward the insert 1400. This narrows, or tapers, the propellant chamber 1340 so the diameter D1 in the upper component 1200 is greater than the diameter D2 closer to the insert 1400. It can be further said that, in an example, a diameter D1 approximate the shoulder 1204 can be greater than the diameter D2 (in the lower component 1300) approximate a flash hole 1418 of the insert 1400. In another example, diameter D2 can equal a diameter D3 of the flash hole 1418.

FIG. 22 illustrates another example of a narrowed propellant chamber 1340. In this example, the propellant chamber 1340 narrows toward the upper component 1200. Thus, a diameter D4 of the upper component 1200 is less than a diameter D5 of the lower component 1300. Additionally, the diameter of the lower component D5 can be greater than the diameter D3 of the flash hole 1418. In one example, the diameter D4 of the upper component 1200 is greater than or equal to a diameter D6 of a back of the bullet 1050.

In the above examples, the cartridge 1000 is described in a three-piece design (upper 1200, lower 1300, and insert 1400). Note that the cartridge 1000 can be fabricated in one-piece, all of polymer as described above, or two pieces, a polymer section and the over-molded insert 1400. Additionally, the flash hole 1418 can also be sloped to match the slope of the inner walls 1217, 1317. Further, while the above examples are described with a constant slope from the upper component 1200 to the lower component 1300, other examples can have differing slopes between the two components 1200, 1300 such that one slope is steeper than the other slope. Further, FIGS. 21 and 22 illustrate cartridges wherein the upper component 1200 is smaller than the lower component 1300. The relative sizes of the two components 1200, 1300, can be alternated or they can be equated.

Further, the slope of the upper component inner wall 1219 can differ from the upper component outer wall 1217. The same can be true for the lower component inner wall 1319 differing in slope from the lower component outer wall 1317.

The polymer construction of the cartridge case also provides a feature of reduced friction between the cartridge and chamber of the firearm. Reduced friction leads to reduced wear on the chamber, further extending its service life.

Subsonic ammunition can be manufactured using the above illustrated examples. Subsonic ammunition is designed to keep the bullet from breaking the speed of sound (approximately 340 m/s at sea level or less than 1,100 fps). Breaking the speed of sound results in the loud "crack" of a sonic boom, thus subsonic ammunition is much quieter than is standard counterpart. Typical subsonic ammunition uses less powder, to produce less energy, in the same cartridge case as standard ammunition. The remaining space is packed with wadding/filler to keep the powder near the flash hole so it can be ignited by the primer. As noted above, increasing the wall thickness eliminates the need for wadding. In one example, while a brass cartridge wall can be 0.0389" thick, the polymer wall and sleeve can have a total thickness of 0.0879" for the identical caliber.

The reduced capacity allows for a more efficient ignition of the powder and a higher load density with less powder. Low load density (roughly below 30-40%) is one of the main contributors to the Secondary Explosive Effect (SEE). SEE can destroy the strongest rifle action and it can happen on the first shot or the tenth. SEE is the result of slow or incomplete ignition of small amounts of smokeless powder. The powder smolders and releases explosive gases which, when finally ignited, detonate in a high order explosion. The better sealing effect is also important here because standard brass does not seal the chamber well at the lower pressures created during subsonic shooting.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A high strength polymer-based cartridge for subsonic ammunition comprising:

a first end having a mouth;

a projectile disposed in the mouth;

a shoulder, disposed below the mouth, forming a bottleneck cartridge;

a wall, molded from a polymer, between the first end and a second end opposite the first end;

an insert joined to the second end, comprising:

an extraction rim and a groove both disposed at one end of the insert; and a primer pocket in fluid communication with a flash hole, the flash hole in fluid communication with a propellant chamber; and a sleeve section, comprising a metal or a metal alloy, extending from the insert toward the first end, at least partially covered by the wall, wherein the sleeve section and the wall form the propellant chamber;

wherein the sleeve section and the wall comprises a thickness at least 1.25 times greater than a standard thickness of a wall of a standard cartridge, wherein the propellant chamber between the mouth and the insert is unobstructed, and wherein the propellant chamber comprises a powder load having a load density greater than 40%.

2. The high strength polymer-based cartridge of claim 1, wherein the insert is made from a metal, an alloy of metals, or an alloy of a metal and a non-metal.

3. The high strength polymer-based cartridge of claim 1, wherein the sleeve section ends below the shoulder.

4. The high strength polymer-based cartridge of claim 1, wherein the insert and the sleeve section are integral and the insert consists of a metal or a metal alloy.

5. The high strength polymer-based cartridge of claim 1, wherein the sleeve section further comprises:

a ridge formed on the sleeve section; and a key formed on the ridge;

wherein both the ridge and the key engage the wall, and wherein the key comprises at least one of a flat portion, a raised portion, or dimples.

6. The high strength polymer-based cartridge of claim 1, wherein the sleeve section further comprises knurling.

7. The high strength polymer-based cartridge of claim 1, wherein the sleeve section further comprises the neck and the mouth.

8. The high strength polymer-based cartridge of claim 1, wherein the propellant chamber permits only enough propellant to propel the projectile engaged in the cartridge casing at subsonic speeds.

* * * * *